United States Patent [19]

Nagashima et al.

[11] Patent Number: 4,602,656

[45] Date of Patent: Jul. 29, 1986

[54] RECEPTACLE FOR USE IN A PORTABLE POWER DRIVEN MACHINE

[75] Inventors: Akira Nagashima, Kawasaki; Toshio Taomo, Tokyo, both of Japan

[73] Assignee: Kioritz Corporation, Tokyo, Japan

[21] Appl. No.: 647,424

[22] Filed: Sep. 5, 1984

[30] Foreign Application Priority Data

Sep. 7, 1983 [JP] Japan ..... 58-137810[U]

[51] Int. Cl.[4] ..... F17D 1/08; F01M 11/03

[52] U.S. Cl. ..... 137/590; 30/381; 184/6.2; 184/6.24

[58] Field of Search ..... 137/590; 30/381; 184/6.2, 6.24

[56] References Cited

U.S. PATENT DOCUMENTS

| | | | |
|---|---|---|---|
| 857,519 | 6/1907 | Foster | 137/590 |
| 1,395,753 | 11/1921 | Wehle | 137/590 |
| 1,581,961 | 4/1926 | King | 137/590 |
| 1,955,308 | 4/1934 | Naftel et al. | 137/590 |
| 2,210,164 | 8/1940 | Bristol | 137/590 |
| 3,068,961 | 12/1962 | Stihl et al. | 184/29 |
| 3,354,905 | 11/1967 | Lewis et al. | 137/590 |
| 3,530,957 | 9/1970 | Shaw et al. | 184/15 |
| 3,865,213 | 2/1975 | McDermott | 184/28 X |
| 4,285,309 | 8/1981 | Johansson | 123/195 C |
| 4,370,809 | 2/1983 | Takahashi et al. | 30/381 |
| 4,393,589 | 7/1983 | Barkhult | 30/381 |

*Primary Examiner*—Alan Cohan
*Assistant Examiner*—John A. Rivell
*Attorney, Agent, or Firm*—Sheridan Neimark; Karl W. Flocks

[57] ABSTRACT

Disclosed is a receptacle for use in a portable power driven machine, which is arranged such that a flexible elastic hose at least partly provided with a coiled portion is allowed to stay within the receptacle by being drawn thereinto from a liquid take-out port, said hose being mounted with a filter at its free end; and the length of said hose allowed to stay within the receptacle is made greater than a distance covering from the liquid take-out port to a liquid inlet port of the receptacle.

2 Claims, 1 Drawing Figure

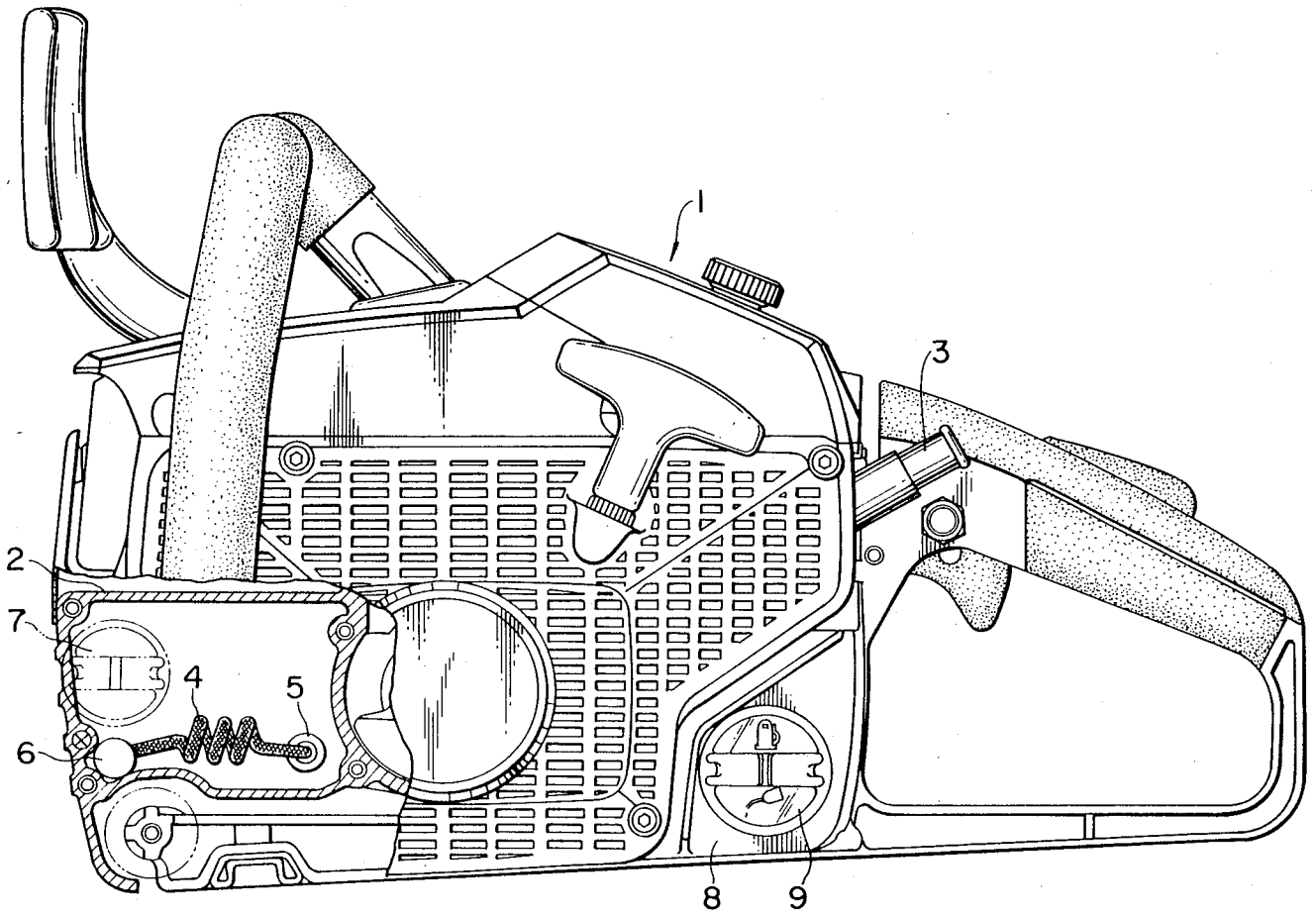
1
2
3
4
5
6
7
8
9

RECEPTACLE FOR USE IN A PORTABLE POWER DRIVEN MACHINE

BACKGROUND OF THE INVENTION

The present invention relates to a receptacle for use in a portable power driven machine in which is stored a liquid such as, for example, an oil, fuel or the like to be supplied to an internal combustion engine and the like built in the machine as a power source.

A prior art receptacle of this type is constructed as follows. That is, within the receptacle, a straight flexible hose is installed, and a filter is mounted on a free end thereof, whereby a liquid stored in the receptacle is sucked into the hose through the filter, said liquid being then supplied from the hose through its fixed end to a desied portion of the machine. The receptacle having this construction, however, had the following drawbacks. Since the length of the hose is fixed, it is difficult for the hose to make its free rolling movement within the receptacle, with the result that the filter is liable to stay at one place, whereby its effectiveness in sucking the liquid from any location in the receptacle is lessened, or that the filter becomes clamped or stuck between protrusions within the receptacle, or engaged on a corner portion thereof, whereby its operation of sucking the liquid from all locations within the receptacle is hindered. Further, since the hose is required to have flexibility, a hose made of a material low in hardness which is very likely to be corroded by fuel or oil must be used to that end. Further, for the same reason, difficulties are encountered in taking out the hose or filter from the inside of the receptacle when the interior thereof is cleaned, when the filter is replaced, etc.

SUMMARY OF THE INVENTION

The object of the present invention is to provide a receptacle for use in a portable power driven machine which eliminates the drawbacks inherent in the above-mentioned prior art receptacle, and which is easy to manufacture and yet simple in structure.

The construction of the present invention is characterized in that a flexible elastic hose at least partly provided with a coiled portion is allowed to stay within the receptacle by being drawn thereinto from a liquid take-out port, said hose being mounted with a filter at its free end; and the length of the hose allowed to stay within the receptacle is made greater than a distance extending from the liquid take-out port to a liquid inlet port of the receptacle.

According to the construction of the present invention, therefore, even when the hose or filter hits against the inner wall of the receptacle due to the vibrations or the like applied thereto from outside, the hose or filter is caused to make its free rolling movement in the receptacle by the spring action of the coiled portion formed on the hose, so that the operation of sucking the liquid is effectively performed; it is impossible that the operation of sucking the liquid is hindered due to engagement or catching of the filter between or on the protrusions in, or on the corner portions of, the receptacle; when the filter hits, due to its spring like movements, against the inner surface of the receptacle, the dust attached onto the outer surface of the filter is exfoliated or separated therefrom, whereby the filtering effect is renewed; and it is possible to use as a hose material one which is relatively hard and unlikely to be corroded by oil or fuel. Further, since the hose can be extended at the time of cleaning the interior of the receptacle, or cleaning or replacing the filter, the draw-out of the filter and hose from a liquid inlet port of the receptacle, or the entry thereof into the receptacle through this port, can be easily effected.

BRIEF DESCRIPTION OF THE DRAWING

The drawing is a side view, partly broken, of a chain saw provided with a receptacle for use in a portable power driven machine according to the present invention.

DETAILED DESCRIPTION OF THE PREFERRED EMBODIMENT

The construction of the present invention will now be described in connection with a preferred embodiment thereof which is illustrated in the drawing.

A chain saw shown generally at 1 in the drawing is arranged such that an internal combustion engine (not shown) is built-in as a power source to drive a chain provided with sawteeth. It has a fuel tank or receptacle 8 and an oil tank or receptacle 2. In this fuel receptacle 8, fuel is stored and this fuel is supplied to the internal combustion engine. Oil in the oil receptacle 2 is supplied, as a lubricating oil, to a sawtooth section through a manually operable pump whose operation lever is shown by a reference numeral 3) or automatic pump in order to permit the cutting operation of the sawteeth to be smoothly performed during the use thereof.

Reference will now be made to the oil receptacle 2 by way of example. A flexible elastic hose 4 is provided within the receptacle 2. The hose 4 is what is called "coiling hose", and is made of rubber, or synthetic resin, material. The hose 4 is formed, at its substantially central portion, with a coiled portion prepared by winding the hose two to three times. For this reason, when no external force is applied, the hose 4 is allowed to stay within the receptacle 2, together with a later described filter, in a state wherein a part thereof is spirally bent or curved as shown. With respect to application of a stretching, bending or twisting stress, the hose 4 makes its rolling movement while it springs in response thereto and varies freely in position.

One end of the hose 4 is allowed to pass, in a state wherein it is sealed, through a liquid take-out port 5 formed in a side wall of the receptacle 2. Said one end is connected to an oil supply passage (not shown) communicated with the manually operable pump or automatic pump. The other end, i.e., a free end, of the hose 4 is integrally mounted with a spherical filter 6. The diameter of the filter 6 is made smaller than that of an oil intake port closed by a cap 7 (indicated in the drawing by phantom lines) as later described, and at the same time the length of the hose 4 extending from the port 5 to the filter 6 which is measured when the same is extended and made straight is made greater than the distance between the liquid take-out port 5 and the oil intake port. Thus, the filter 6 can be easily drawn outside the oil receptacle 2 through the oil intake port.

The oil intake or inlet port of the oil receptacle 2 closed by the cap 7 is formed in a side wall opposite to the side wall provided with the liquid takeout port 5, i.e., in that portion of the side wall residing on the outer side of a machine body which is broken away from the drawing. The cap 7 is of a similar shape to that of a cap 9 closing a fuel inlet port of the fuel receptacle 8.

During the operation, the oil in the receptacle 2 enters the interior of the filter 6 while it is being filtered by the same, and then passes through the hose 4 up to the liquid take-out port 5, and thus is supplied from it to the above-mentioned pump.

Similarly, the fuel in the fuel receptacle 8 is sucked into the interior of a filter while it is being filtered by the same, and then passes through a hose and thus is supplied to a carburetor of the internal combustion engine.

What is claimed is:

1. A receptacle for use in a portable power driven machine to store a liquid, such as oil or fuel, to be supplied to the machine, comprising a closed container adapted to store the liquid, having a closable inlet port and a liquid take-out port;

a flexible elastic hose extending into said container from said liquid take-out port and having a fixed straight end portion, a free straight distal end portion, and a tightly spirally coiled central portion, said tightly spirally coiled central portion constituting a spring means for insuring rolling movement of said distal end portion of said hose within said container;

a filter mounted on a free end of said distal end portion of said hose, said filter having a smaller diameter than the diameter of said closable inlet port;

said flexible elastic hose having a normal coiled length and a stretched length, said normal coiled length being shorter than the distance betwen said take-out port and said inlet port, and said stretch length being obtained when said hose is extended to straighten said tightly spirally coiled central portion, said stretched length exceeding the distance between said take-out port and said closable inlet port at least sufficient to extend said filter, while still mounted on said hose, out of said closable inlet port.

2. A device according to claim 1 wherein said tightly spirally coiled central portion has at least two turns.

* * * * *